US005647729A

United States Patent [19]

de Jong et al.

[11] Patent Number: 5,647,729

[45] Date of Patent: Jul. 15, 1997

[54] RADIAL PISTON PUMP

[75] Inventors: Leendert Willem C. de Jong, Oldenzaal; Arjan Peter van Heiningen, Haaksbergen; Willem Herman Masseling, Oldenzaal, all of Netherlands

[73] Assignee: Applied Power Inc., Butler, Wis.

[21] Appl. No.: 381,827

[22] PCT Filed: Jun. 13, 1994

[86] PCT No.: PCT/NL94/00141

§ 371 Date: Feb. 7, 1995

§ 102(e) Date: Feb. 7, 1995

[87] PCT Pub. No.: WO94/29592

PCT Pub. Date: Dec. 22, 1994

[30] Foreign Application Priority Data

Jun. 11, 1993 [NL] Netherlands ..... 9301010

[51] Int. Cl.[6] ..... F04B 1/04

[52] U.S. Cl. ..... 417/273; 91/496

[58] Field of Search ..... 417/273; 91/491, 91/496; 92/72, 148

[56] References Cited

U.S. PATENT DOCUMENTS

| | | | |
|---|---|---|---|
| 4,977,606 | 12/1990 | Budecker | 417/273 |
| 5,382,140 | 1/1995 | Eisenbacher | 417/273 |
| 5,509,347 | 4/1996 | de Jong et al. | 417/273 |

FOREIGN PATENT DOCUMENTS

| | | |
|---|---|---|
| 1453663 | 3/1969 | Germany . |
| 513334 | 11/1971 | Sweden . |
| 309745 | 4/1929 | United Kingdom . |
| 1051603 | 12/1966 | United Kingdom . |

*Primary Examiner*—Timothy Thorpe
*Assistant Examiner*—Peter G. Korytnyk
*Attorney, Agent, or Firm*—Quarles & Brady

[57] ABSTRACT

A radial piston pump with pistons which pump into a circumferential pressure passage has the passage sealed on its outer side by a plastic annular member of a trapezoid-shaped cross-section. The longer parallel side of the cross-section faces radially inwardly and includes a circumferential groove for receiving a resilient O-ring which biases closed pressure valves located between the pistons and the passage. The annular member is adapted to be inserted radially inwardly into the circumferential pressure passage by expanding it and allowing it to contract into the passage. A radially inner side of the circumferential passage is, at a location between two adjacent cylinders, connected to a passage that extends radially inwardly and that is connected to an axial passage that leads to a pressure connection.

3 Claims, 2 Drawing Sheets

RADIAL PISTON PUMP

BACKGROUND OF THE INVENTION

1. Field of the Invention

The invention relates to a radial piston pump of the type, in which an eccentric rotor is adapted to cause the pistons to perform a reciprocating movement within radial cylinders in a pump body.

2. Discussion of the Prior Art

Radial piston pumps of the type in which the cylinders are connected via a lateral suction opening to a liquid reservoir and have their radial outer ends each connected to a circumferentially located pressure passage through a connecting opening that accommodates a pressure valve. The pressure valves are pressed on seats within the respective connecting openings by means of at least one common resilient ring member that is located within the circumferential passage under tangential pretension. An annular wall portion surrounds the pump body to overlie and cover the circumferential pressure passage in the valve body. Such a pump is disclosed in German Offenlegungsschrift 1.453.663.

With this well-known pump the annular wall portion surrounding the pump body is intended to close the circumferential pressure passage at the outer circumference thereof. The tightness of the circumferential passage as a pressure passage is completely determined by sealing rings provided in circumferential grooves on either side of the circumferential pressure passage.

SUMMARY OF THE INVENTION

The invention aims at providing an improved pump of the above type, which is suitable for higher pump pressures (up to 1000 bar) and which is of a compact and light-weight construction, which is of particular importance for use in hydraulically operated tools.

In accordance with the invention this aim is achieved in that the circumferential pressure passage is outwardly sealed by an annular member of plastic material and of a substantially trapezoid-shaped cross-section. The longer parallel side of the cross-section faces radially inwardly and includes a circumferential groove for receiving the resilient ring member. The annular member is adapted to be inserted radially inwardly into the circumferential pressure passage.

To enable the annular member of plastic material to be placed into the circumferential pressure passage in a radial inward direction, the annular member will, at first, have to be expanded and placed in position on the circumferential outer surface of the pump body from an end of the latter, after which the annular member is permitted to contract to its original (untensioned) diameter and width and thereby engage into the circumferential pressure passage. Due to the trapezoid-shaped cross-section of the annular member of plastic material the latter will tend to slightly bulge convexly outwardly beyond the circumferential outer surface of the pump body. The annular wall portion, however, will cause the annular member of plastic material to return to a flat shape (as seen in the axial direction), due to which the annular member will be pressed with its inwardly facing base of the trapezoid firmly against the sidewalls of the circumferential passage. In operation, the pressure of the annular member of plastic material against the sidewalls of the circumferential pressure passage will be further increased by the pressure prevailing within the inner circumferential groove of the annular member, which pressure tends to bend the lateral wall portions on either side of the groove axially outwardly.

In accordance with a further feature of the invention the bottom of the circumferential passage is, at a location between two adjacent cylinders, connected to a passage that extends radially inwardly and is, in turn, connected to an axial passage that leads to a pressure connection.

The invention will be hereinafter further described by way of example with reference to the accompanying drawing.

SUMMARY OF THE INVENTION

DETAILED DESCRIPTION OF THE PREFERRED EMBODIMENT

The annular pump body 1 is surrounded by an annular wall member 2 and has a number of radially directed pumping cylinders 3, in which pistons 4 are mounted for a reciprocating movement.

Figure 1:
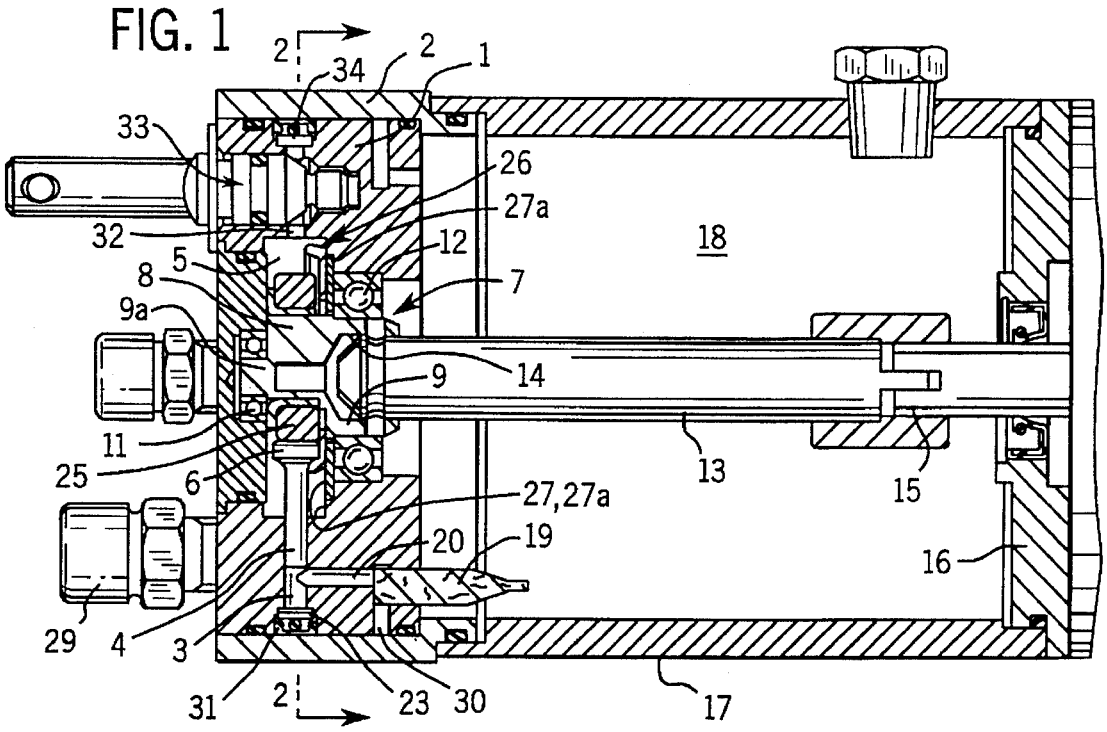
FIG. 1 shows a axial cross-sectional view through a radial piston pump according to the invention, as seen along the line I—I in FIG. 2.
Figure 2:
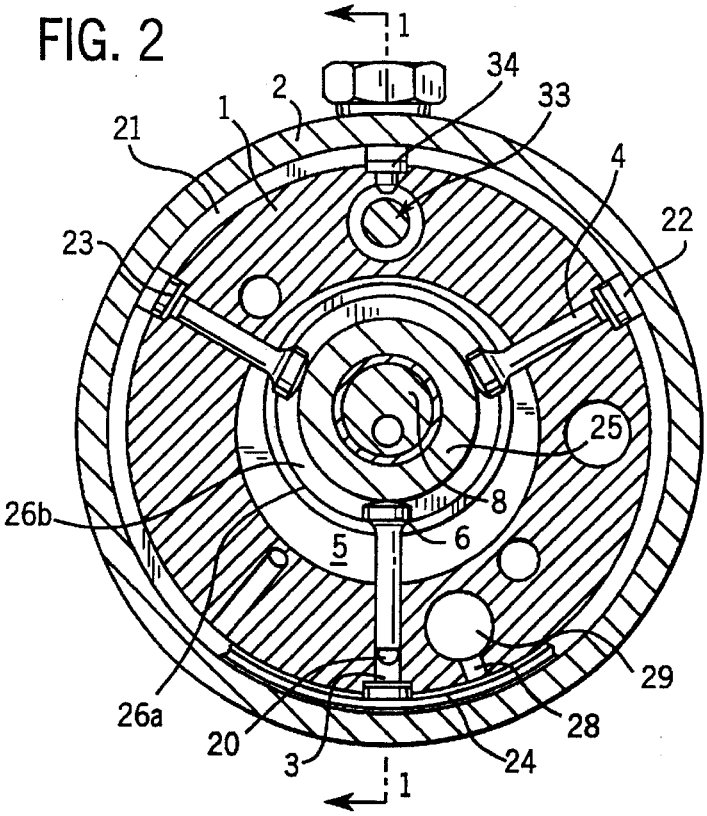
FIG. 2 represents a cross-section along the line II—II in FIG. 1.
Figure 3:
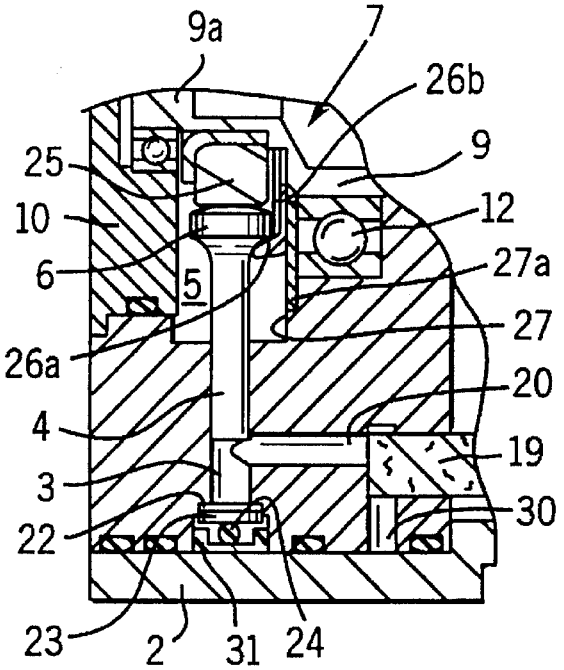
FIG. 3 is an enlarged longitudinal cross-sectional view through the left lower part of the device of FIG. 1

The pump body 1 confines a central space 5, into which the radial inner ends project and which also accommodates the eccentric part 8 of the rotor 7; the radial inner piston ends broaden into heads 6. One end (i.e. the left end as seen in FIG. 1) of the central space 5 (FIG. 3) is closed by a cover 10 and at a distance from the latter within the pump body 1 ball bearings 11 and 12 are provided, in which the centric portion 9, 9*a* of the rotor 7 is journalled.

13 designates a connecting shaft, made e.g. of a suitable artificial resin, one end of which non-rotatably engages in central bore 14 in the centric portion 9 of the rotor 7 and the other end of which non-rotatably engages the drive shaft 15 of the pump engine (electric motor) 16.

The space between the pump body 1 and the housing of the electric motor 16 is radially outwardly confined by a shell 17, which is an extension of the annular wall member 2 and constitutes the outer wall of a reservoir 18 for the liquid to be pumped. Liquid may flow from the reservoir 18 through a filter 19 into a suction passage 30 and through suction openings 20 into each of the cylinders 3; the suction passage 30 is constituted by a circumferential groove of a relatively large depth.

The radial outer ends of the cylinders 3 merge into a circumferential passage 21 that is provided in the outer wall of the pump body 1. The connecting openings between the cylinders 3 and the circumferential passage 21 are broadened into chambers 22 for disc-shaped pressure valves 23. The pressure valves 23 are pressed on their seats by means of a common resilient closure element, that is received within the circumferential passage 21 and is constituted by a tangentially pre-stressed O-ring 24; the tangential pretension of the ring 24 produces a radially inwardly directed closing force on each of the pressure valves 23.

The circumferential passage 21 is radially outwardly closed by an annular member 31 of plastic material, having at its circumferential inner surface a groove for receiving the O-ring 24; a radially directed connecting passage 28 (FIG.

2), which may be selected rather arbitrarily, connects the circumferential passage 21 to a connection 29 for the pressure line that is provided on the end wall of the pump body 1. The annular member 31 of the plastic material has a trapezoid-shaped cross-section, the longer parallel side of which faces radially inwardly. This shape contributes to a very reliable sealing of the annular member relative to the two sidewalls of the circumferential passage, thereby enabling pumping pressures up to 1000 bar.

Figure 4:
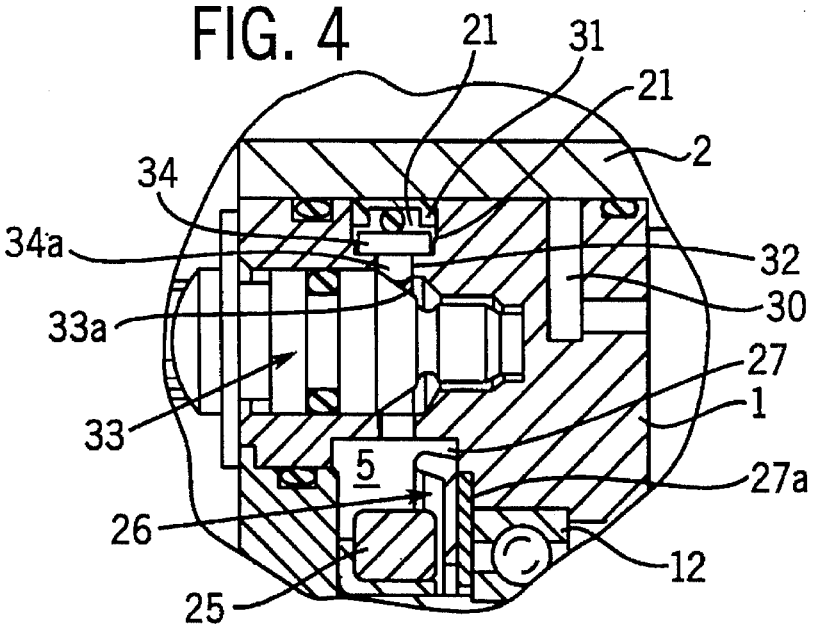
FIG. 4 is an enlarged cross-sectional view of the left upper part of FIG. 1.

Another radial branch of the circumferential pressure passage 21 is indicated at 32; it connects the circumferential passage to the space 5 and intersects an axial bore for a relief valve-control member 33 (see FIG. 4).

The connecting opening between the passage 32 and the circumferential passage 21 is, in a manner similar to the connecting opening of the cylinders 3, broadened to a chamber, in which a relief valve 34 is received, the latter being also pressed on its seat by means of the O-ring 24. The relief valve 34 is provided with a radially inwardly extending short stem 34*a*, that cooperates with a conical pressure surface 33*a* of the control member 33. By turning the control member a number of times and thereby screwing it axially into the pump body 1 the stem 34*a* and thereby the valve 34 will be lifted from its seat against the closing action of the O-ring 24. This causes a relief of the pressure within th circumferential passage 21 via the passage 32 and the space 5 (which is connected to the reservoir 18 via the parts 26, 27*a* and 12).

A similar branch could lead to an overload valve within the reservoir 18 via an axial passage connected to it.

The effective outer circumferential portion of the eccentric rotor part 8 is formed by a slide bearing ring 25 mounted on said rotor part. While the rotor 7 is rotating the slide bearing ring 25 will remain stationary relative to the eccentric rotor part 8, so that it will merely perform a translational movement relative to the pump body 1.

The pistons have their radial inner ends 6 engaging the ring 25 and are caused by the rotating rotor 7 to reciprocate within the respective cylinders. Each time the rotor will cause a piston to move radially outwardly so as to perform a pressure stroke, whereby the respective pressure valve 23 is lifted from its seat against the radially inwardly directed closure force of the O-ring 24, while another piston is performing an inwardly directed suction stroke so as to extract liquid (e.g. hydraulic fluid) from the reservoir 18 through the respective suction opening 20 via the suction passage 30 and the filter 19 (while the respective pressure valve is kept closed).

To perform a suction stroke the pistons will have to follow the eccentric rotor part 8, which means that the contact between the radial inner piston ends and the rotor part 8 (i.e. the slide bearing ring 25) must be maintained. In accordance with the present invention this is achieved in a simple and effective manner by means of a loosely mounted coupling ring 26.

An axially directed ring portion 26*a* of the coupling ring 26 engages the outwardly facing end faces of the heads 6 and thereby keeps said heads in contact with the ring 25 of the eccentric rotor part 8. Art annular disc portion 26*b* is connected with the ring portion 26*a* and is positioned in a plane at right angles to the pump axis; this annular disc portion 26*b* is loosely positioned between the right-hand end face (as seen in the drawing) of the slide bearing ring 25 and the opposite end face 27 of the pump body 1 or a filling ring 27*a* lying flush therewith respectively. The coupling ring 26, which may be formed of a suitable artificial resin, is coaxially positioned relative to the eccentric rotor part 8 and is performing, in operation, a translational movement together with the slide bearing ring 25 relative to the stationary pump body 1.

The coupling ring 26 could also be mounted on the opposite side of the bearing 25. In that case the annular disc portion 26*b* would become loosely positioned between the left end surface of the slide bearing ring 25 and the inner side of the cover 10.

We claim:

1. A radial piston pump of the type in which an eccentric rotor is adapted to cause pistons to perform a reciprocating movement within radial cylinders in a pump body, said cylinders being connected to a liquid reservoir and having their radial outer ends each connected to a circumferentially located pressure passage through a connecting opening that accommodates a pressure valve, said pressure valves being pressed on seats within the respective connecting openings by means of at least one common resilient ring member that is located within said circumferential pressure passage under tangential pre-tension, an annular wall portion surrounding said pump body to overlie and cover said circumferential pressure passage in said pump body, characterized in that said circumferential pressure passage is outwardly sealed by an annular member of plastic material and of a substantially trapezoid-shaped cross-section, a longer parallel side of said cross-section facing radially inwardly and comprising a circumferential groove for receiving said resilient ring member, said annular member being adapted to be inserted radially inwardly into said circumferential pressure passage.

2. A radial piston pump according to claim 1, characterized in that a radially inner side of said circumferential passage is connected at a location between two adjacent cylinders, to a passage that extends radially inwardly and that is connected to an axial passage that leads to a pressure connection.

3. A radial piston pump according to either of claims 1 and 2, characterized in that said resilient ring member is an O-ring.

* * * * *